US012716188B2

(12) United States Patent
Binon et al.

(10) Patent No.: US 12,716,188 B2
(45) Date of Patent: Aug. 25, 2026

(54) BORING MACHINE COMPRISING A VARIABLE-GEOMETRY CUTTING DEVICE

(71) Applicant: SOLETANCHE FREYSSINET, Rueil Malmaison (FR)

(72) Inventors: Stéphane Binon, Rueil Malmaison (FR); Michel Coudry, Rueil Malmaison (FR); Lionel Arfoulu, Rueil Malmaison (FR)

(73) Assignee: Soletanche Freyssinet, Rueil Malmaison (FR)

( * ) Notice: Subject to any disclaimer, the term of this patent is extended or adjusted under 35 U.S.C. 154(b) by 349 days.

(21) Appl. No.: 18/557,722

(22) PCT Filed: Apr. 20, 2022

(86) PCT No.: PCT/EP2022/060450

§ 371 (c)(1),
(2) Date: Oct. 27, 2023

(87) PCT Pub. No.: WO2022/228972

PCT Pub. Date: Nov. 3, 2022

(65) Prior Publication Data

US 2024/0410126 A1 Dec. 12, 2024

(30) Foreign Application Priority Data

Apr. 28, 2021 (FR) ..... 2104451

(51) Int. Cl.

| | |
|---|---|
| ***E02F 3/18*** | (2006.01) |
| ***E02F 3/20*** | (2006.01) |
| ***E02F 3/22*** | (2006.01) |

(52) U.S. Cl.

CPC ..... *E02F 3/183* (2013.01); *E02F 3/188* (2013.01); *E02F 3/205* (2013.01); *E02F 3/22* (2013.01)

(58) Field of Classification Search
None
See application file for complete search history.

(56) References Cited

U.S. PATENT DOCUMENTS

| | | | | |
|---|---|---|---|---|
| 10,697,147 | B2 | 6/2020 | Cascarino et al. | |
| 2005/0000122 | A1* | 1/2005 | Chagnot | E02F 3/3609 37/352 |
| 2006/0032096 | A1* | 2/2006 | Stoetzer | E02F 3/26 299/71 |

FOREIGN PATENT DOCUMENTS

| | | | |
|---|---|---|---|
| EP | 0496926 A1 * | 8/1992 | E02F 3/205 |
| FR | 2211027 A5 | 7/1974 | |

(Continued)

OTHER PUBLICATIONS

International Search Report, mailed Aug. 2, 2022, from PCT/EP2022/060450, 6 pages.

*Primary Examiner* — Christopher J Sebesta
*Assistant Examiner* — Alfred H Tsui
(74) *Attorney, Agent, or Firm* — Workman Nydegger

(57) ABSTRACT

The invention relates to a boring machine (10) including: a frame (12) bearing at least a first rotary milling drum, at least a first arm (40) movable with respect to the body (16); at least a first support (64) bearing the first milling drum (60), the first support (64) being connected to the lower end part (40*b*) of the first arm (40), an actuating device (50) to displace at least the first arm (40) with respect to the body (16). The invention is characterized by the fact that the body further includes: a translational guiding device (30) extending along the longitudinal direction, the boring machine further comprising a movable member displaceable with respect to the body along the longitudinal direction while being guided by the translational guiding device (30), the first arm (40) being mounted pivotably on the movable member (34).

16 Claims, 5 Drawing Sheets

(56) References Cited

FOREIGN PATENT DOCUMENTS

| | | | | |
|---|---|---|---|---|
| JP | 54-090802 | A | | 7/1979 |
| JP | S6245831 | A | | 2/1987 |
| JP | S6245831 | B2 | * | 9/1987 |
| JP | H0195924 | A | * | 4/1989 |
| JP | 06-035332 | U | | 5/1994 |
| JP | H06128960 | A | | 5/1994 |
| JP | H10195924 | A | | 7/1998 |
| JP | 2012-162975 | A | | 8/2012 |

* cited by examiner

[Fig. 1]
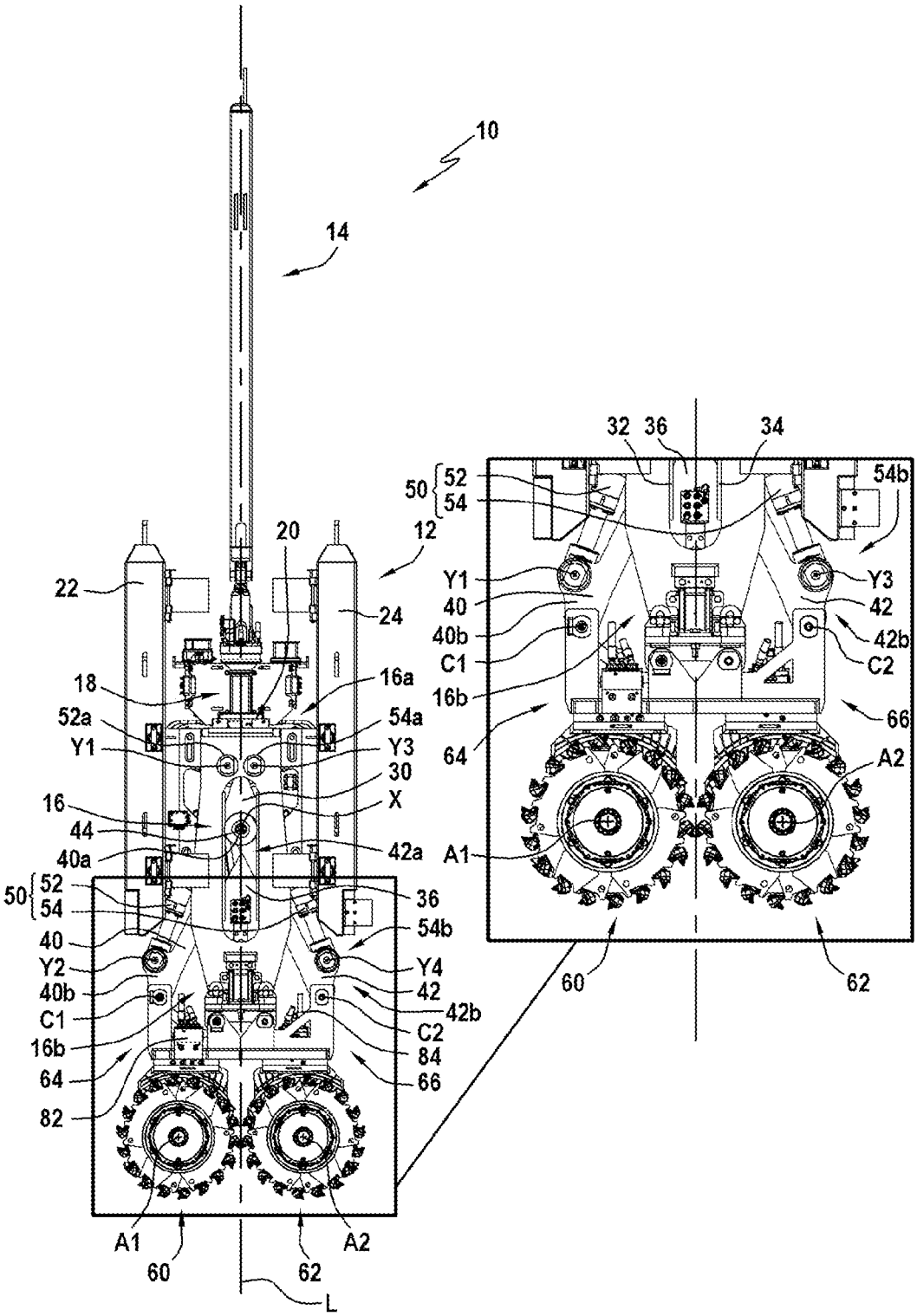

[Fig. 2]
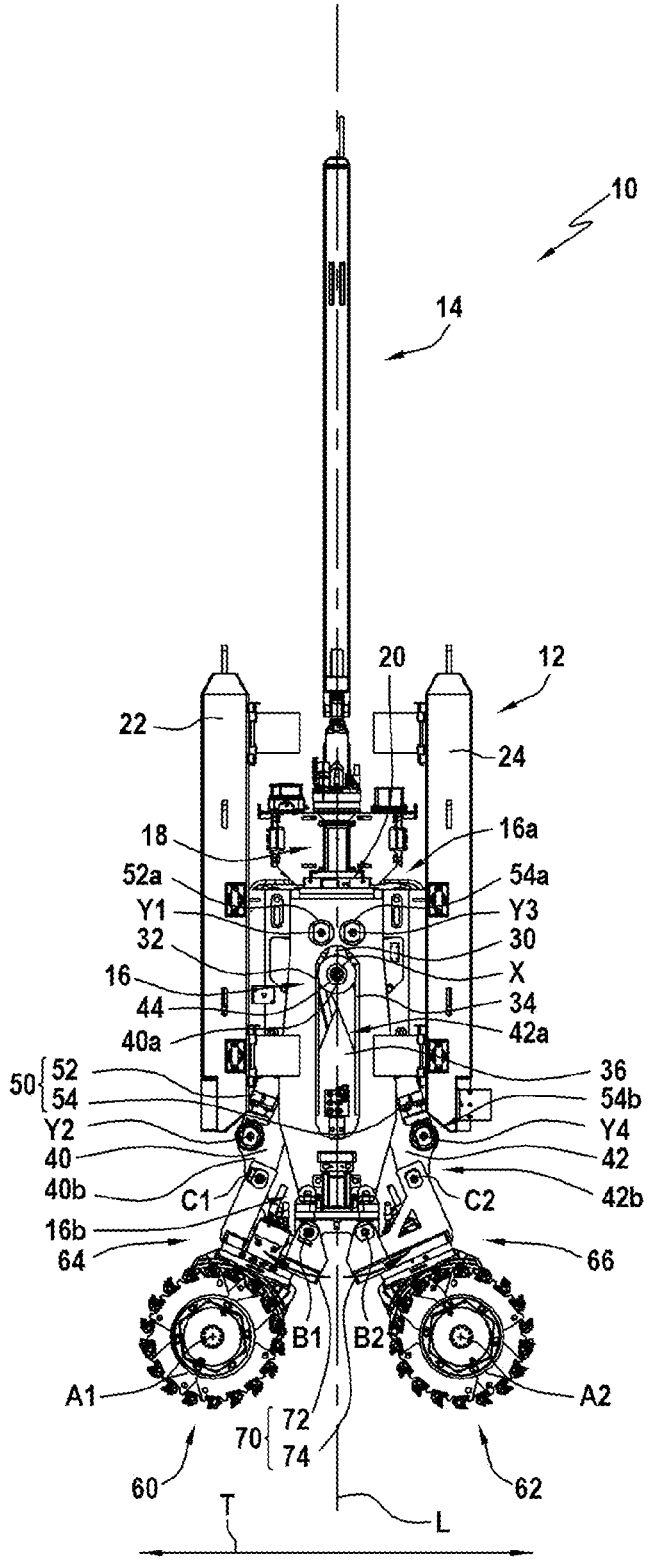

[Fig. 3]
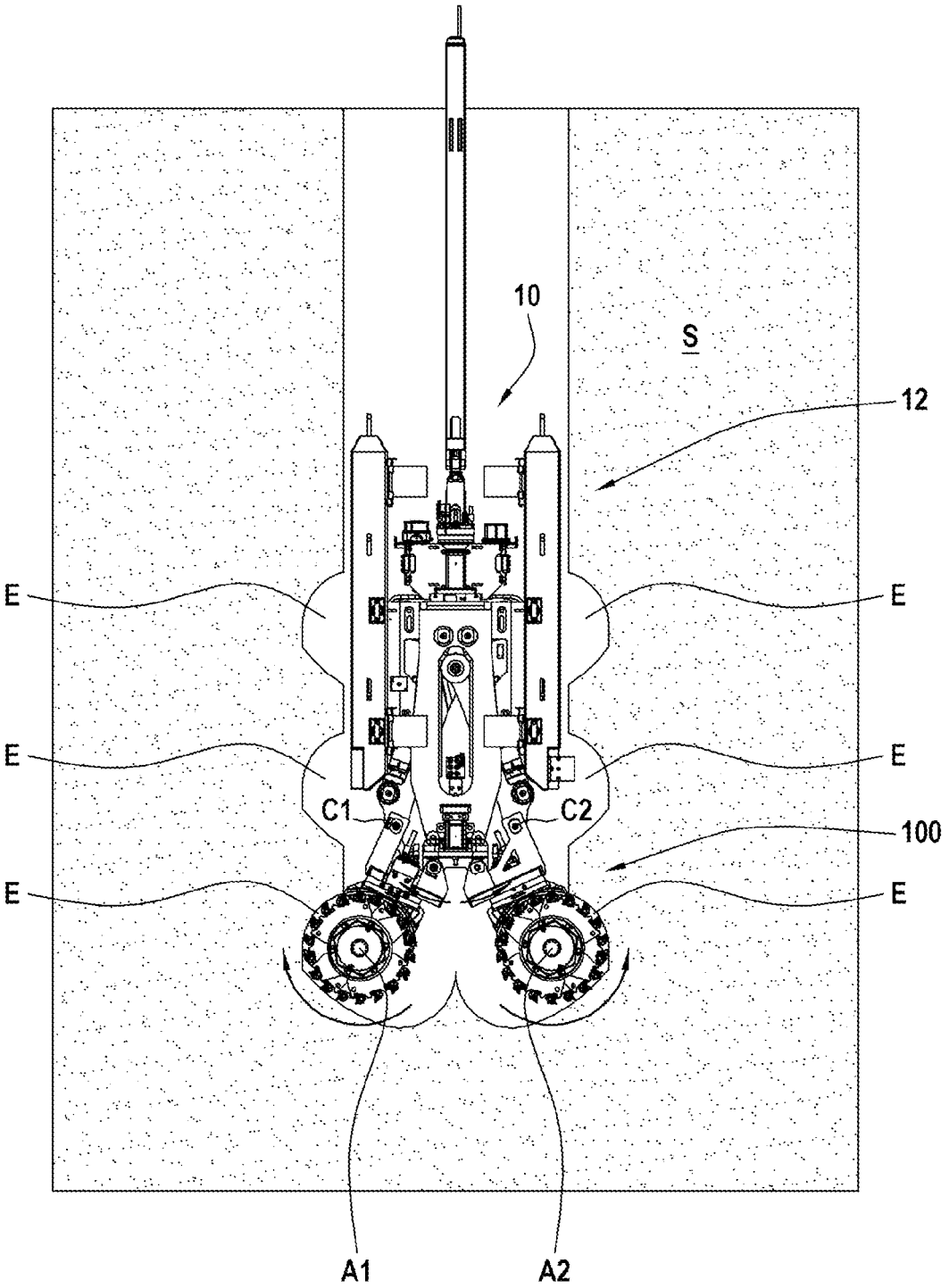

[Fig. 4]
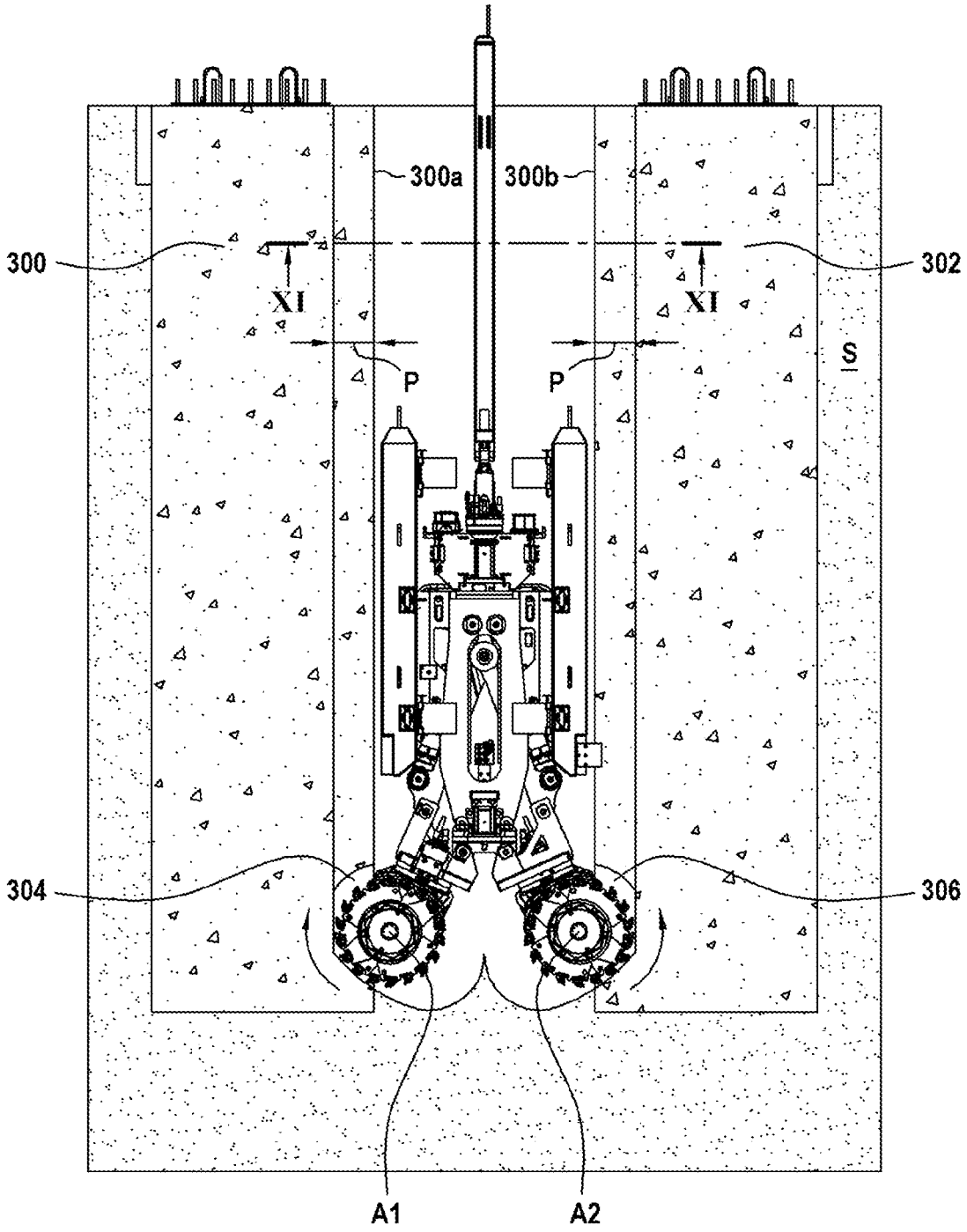

[Fig. 5]
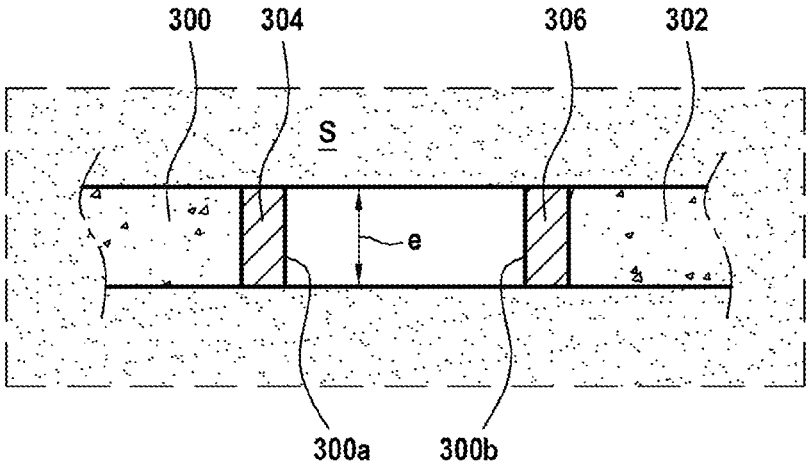
[Fig. 6]
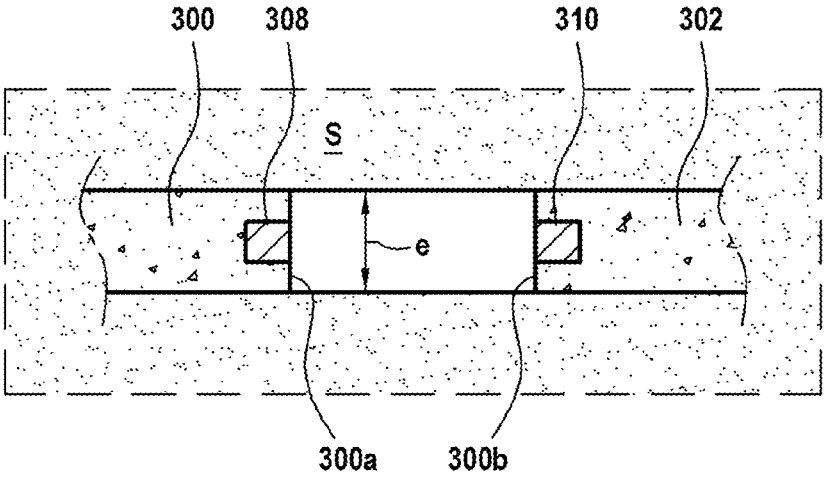

BORING MACHINE COMPRISING A VARIABLE-GEOMETRY CUTTING DEVICE

TECHNICAL FIELD

This invention relates to the field of soil excavation. In particular, it has the subject of a boring machine equipped with a variable-geometry milling device.

PRIOR ART

To make an excavation in soil, for example a trench, it is known to use a machine, commonly known as a "hydromill", which includes a frame suspended from the mast of a carrier, the lower end of the frame bearing a milling device which is generally equipped with one or two rotary milling drums. The rotary drums, also known as milling drums, include cutting tools disposed on the periphery of the milling drum or drums.

Such a boring machine is in particular described in the document FR2211027.

The cross-section of the trench, considered in a horizontal plane, which is obtained using such a machine is substantially constant over the entire depth of the trench.

The excavation operations can however require an increase in the cross-section of the trench, for example locally on the trench floor.

To do this, the document US2006/0032096 makes provision for a boring machine equipped with two milling drums, each drum being mounted on a support which can pivot with respect to the frame. This makes it possible to vary the distance between the axes of rotation of the drums.

The pivoting of the supports is obtained using an actuating mechanism composed of two small articulated levers, attached to the supports pivotably and to the end of a hydraulic cylinder, which is itself attached to the lower end of the frame.

The structure of this actuating mechanism is fragile and nonetheless does not make it possible to exert a significant torque on the supports. In some cases, it can therefore be difficult to deploy the milling drums.

SUMMARY OF THE INVENTION

An aim of the invention is to make provision for a boring machine equipped with a variable-geometry milling device having an alternative structure which is more robust and particularly makes it possible to supply a greater pivoting torque than in the prior machine.

To do this, the invention relates to a boring machine including:

- a frame bearing at least one milling drum, the frame having a body extending along a longitudinal direction;
- at least a first motor to drive the first milling drum in rotation about a first axis of rotation;
- at least a first arm having a lower end part, the first arm being movable with respect to the body;
- at least a first support bearing the first milling drum and the first motor, the first support being connected to the lower end part of the first arm while being movable with respect to the body of the frame,
- an actuating device connected to the body to displace at least the first arm with respect to the body.

Characteristically, the body further includes:

- a translational guiding device extending along the longitudinal direction,

- the boring machine further comprising a movable member disposed in the body above the first support and interacting with the translational guiding device such that the movable member is displaceable with respect to the body along the longitudinal direction while being guided by the translational guiding device, the first arm being mounted pivotably on the movable member.

Unlike the prior boring machine wherein the actuating device is composed of a small hydraulic cylinder disposed outside the frame, the arrangement according to the invention makes it possible to mount a more powerful actuating device in the body of the frame.

Furthermore, the translational guiding device, which has the function of guiding the translational displacement of the movable member, also makes it possible to guide and stabilize the displacement of the first arm.

This arrangement makes it possible to transfer more force between the actuating device and the first support than in the prior mechanism. This has the effect of obtaining a pivoting torque of the first support which is substantially greater than in the machine of the aforementioned prior document.

The longitudinal direction is preferably vertical. The first axis of rotation is preferably perpendicular to the longitudinal direction.

It will moreover be understood that the translational guiding device is separate from the actuating device.

Advantageously, the movable member is housed in the translational guiding device such as to form together a sliding coupling. Preferably, the movable member is movable inside the guiding device. Still preferably, the translational guiding device and the movable member are located in the frame.

Advantageously, the translational guiding device is integrated into the frame and the movable member is disposed in the frame.

Advantageously, the actuating device is attached to the body above the translational guiding device.

The translational guiding device preferably includes two parallel rails extending along the longitudinal direction of the body and together delimiting a passage for the movable member.

According to an advantageous embodiment, the first support is attached to the body pivotably about a first pivoting axis, and is attached to the lower end part of the first arm pivotably about a first axis of pivot,

- whereby the actuating of the actuating device has the effect of making the first milling drum pivot with respect to the body about the first pivoting axis.

Preferably, considered along the longitudinal direction, the axis of pivot is disposed above the first pivoting axis.

Furthermore, considered along a transverse direction perpendicular to the longitudinal direction and perpendicular to the first pivoting axis, the first axis of rotation is preferably located between the first axis of pivot and the first pivoting axis when the boring machine is in the retracted position.

This arrangement makes it possible to install a first arm which is greater and more robust than the small levers of the prior boring machine.

Advantageously, the frame further includes a second arm which is connected to the movable member, the second arm having a lower end part, the first and second arms being pivotable with respect to one another, the actuating device being configured to displace the second arm with respect to the body, said boring machine further including:

- a second milling drum and a second motor to drive the second milling drum in rotation about a second axis of rotation; and a second support which is movable with respect to the body, the second milling drum and the second motor being mounted on the second support, the second support being connected to the lower end part of the second arm.

Preferably, the second support is attached to the body pivotably about a second pivoting axis, and is attached to the lower end part of the second arm pivotably about a second axis of pivot, whereby the actuating of the actuating device has the effect of making the second milling drum pivot with respect to the body about the second pivoting axis.

The second pivoting axis is preferably parallel to the second axis of pivot and to the second axis of rotation.

Still preferably, the first and second axes of pivoting are parallel.

Without departing from the scope of this invention, the first and second axes of pivoting can be colinear.

In an advantageous arrangement, the first and second axes of pivot are located above the first and second axes of pivoting.

Preferably, the first and second milling drums can be pivoted about their respective axes of pivoting independently of one another. The pivoting amplitude is preferably between 0° and 60°. Preferably, the pivoting amplitude of the milling drums about the axes of pivoting is the same for both drums. Without departing from the scope of this invention, the two milling drums can have different deployment amplitudes.

Advantageously, considered along g a transverse direction perpendicular to the longitudinal direction and to the first pivoting axis, the first and second axes of pivoting are located between the first and second axes of pivot.

Advantageously, the boring machine has a retracted position wherein the separation between the first and second milling drums is minimal, the boring machine further including a stop device in order to maintain the minimum separation between the first and second milling drums when the boring machine is in the retracted position.

It will be understood that the transition between the retracted position and a deployed position is made by actuating the actuating device.

The boring machine described in the document US2006/0032096 also has the drawback that the milling drums can come into contact with one another if the cylinder is too retracted or badly adjusted, which will of necessity lead to damage or breakage of the milling drums.

Owing to the invention, the stop device contrariwise makes it possible to avoid the first and second milling drums coming into contact with one another when they are brought closer to one another, in such a way as to preserve a minimum separation, for example of a few centimeters, between the two milling drums.

Preferably, the first and second supports are shaped to come into contact with one another when the boring machine is in the retracted position, the stop device consisting of stop faces disposed face-to-face on each of the first and second supports.

According to a preferred embodiment, the actuating device includes a first actuator which is connected to the body and to the first arm to displace the first arm with respect to the body, and a second actuator which is connected to the body and to the second arm to displace the second arm with respect to the body. The first and second actuators are preferably attached to the body pivotably. Still preferably, the first and second actuators are connected to the body above the translational guiding device.

Without departing from the scope of this invention, the actuating device may comprise a main actuator attached to the body on the one hand and to the movable member on the other. In this embodiment the actuating of the main actuator has the effect of displacing the movable member in translation, the displacement of the movable member causing the pivoting of the first and second arms.

To quickly remove the boring machine from the suspension device, the frame further includes a swivel joint which is connected to the body by way of a removable element.

One benefit is to be able to quickly replace the frame of the boring machine according to the invention with another frame, for example a grab frame, while keeping the same carrier.

BRIEF DESCRIPTION OF THE DRAWINGS

The invention will be better understood on reading the following description of an embodiment of the invention given by way of non-limiting example, with reference to the appended drawings, wherein:

FIG. 1 is a front view of an embodiment of the boring machine according to the invention, the milling drums being in the retracted position;

FIG. 2 is a front view of the boring machine of FIG. 1, the milling drums being in the deployed position;

FIG. 3 illustrates an example of use of the boring machine of FIG. 1 to make cavities at different depths in two adjacent soil portions;

FIG. 4 shows an example of use of the boring machine of FIG. 1 illustrating a step during which the milling device overcuts the vertical edges of two adjacent panels;

FIG. 5 is a view taken in a horizontal plane, illustrating the overcut area during the step of FIG. 4; and FIG. 6 illustrates a variant of FIG. 5, wherein the panels are overcut over a fraction of their thickness such as to create a paving notch joint.

DETAILED DESCRIPTION

Using FIGS. 1 and 2, a description will now follow of a boring machine 10 in accordance with this invention.

The boring machine 10 includes a frame 12 which is attached to the end of a suspending element 14, the latter being connected to a mast of a carrier not illustrated here.

In accordance with the invention, the frame includes a body 16 extending along a longitudinal direction L between an upper end part 16*a* and a lower end part 16*b*.

In this non-limiting example, the frame 12 includes a swivel joint 18 which is attached to the upper end part 16*a* of the body 16 by way of a removable element 20. The swivel joint is moreover connected to the suspending element 14. The removable element 20 makes it possible to easily replace the frame 12 with another frame for example bearing another type of boring device, for example a grab frame.

In this example, the frame further includes a first guiding element 22 and a second guiding element 24 which are disposed on either side of the body 16.

These guiding elements extend along a longitudinal direction L and are intended to bear against the walls of the trench to guide the vertical displacement of the boring machine 10 through the soil.

The body 16 further includes a translation guiding device 30 which extends along the longitudinal direction L. In this example, the translational guiding device 30 includes a first rail 32 and a second rail 34 which are parallel to one another while extending along the longitudinal direction L, the first and second rails 32, 34 together delimiting a passage 36 the usefulness of which will be detailed below.

The frame moreover includes a first arm 40 which has an upper end part 40*a* and a lower end part 40*b*.

In this example, the frame further includes a second arm 42 having an upper end part 42*a* and a lower end part 42*b*.

As can be seen in FIG. 1, the upper end parts 40*a*, 42*a* of the first and second arms are connected to a movable member 44 which takes the form of a roller housed in the aforementioned passage 36 of the translational guiding device 30. The movable member is therefore housed in the translational guiding device 30 and is guided in translation along the longitudinal direction by the first and second rails. In other words, the movable member 44 is housed in the translational guiding device 30 such as to form together a sliding coupling oriented along the longitudinal direction L. In this example, the translational guiding device 30 is integrated into the frame 12, and the movable member 44 is disposed in the frame 12.

More precisely, in this non-limiting example, the first and second arms are pivotable with respect to one another about a coupling axis X which is perpendicular to the longitudinal direction L.

More precisely, each of the first and second arms 40, 42 is pivotable with respect to the movable member 44 about the coupling axis X.

It will therefore be understood that the first and second arms 40, 42 are movable with respect to the body 16.

The boring machine 10 according to the invention moreover includes an actuating device 50 which, in the embodiment described in FIGS. 1 and 2, includes a first actuator 52, consisting of a hydraulic cylinder, and a second actuator 54, also consisting of a hydraulic cylinder. It will be understood that the actuating device 50 is connected to the body 16 to displace the first arm and the second arm 42 with respect to the body 16. In this example, the translational guiding device 30 is separate from the actuating device 50.

In this non-limiting example, the first actuator 52 includes an upper end 52*a* which is mounted on the body 16 pivotably about an axis Y1. The first actuator 52 is moreover connected to the lower end part 40*b* of the first arm 40 pivotably about an axis Y2 which is parallel to the axis Y1.

Similarly, the second actuator 54 has an upper end 54*a* which is attached to the body 16 pivotably about an axis Y3, parallel to the axis Y1. The second actuator 54 also includes a lower end 54*b* which is connected to the lower end 42*b* of the second arm 42 pivotably about an axis Y4, which is parallel to the axis Y3.

It can be seen in this example that the upper ends of the first and second actuators 52, 54 are attached above the translational guiding device 30.

It will be understood that the actuating of the first and/or second actuators 52, 54 has the effect of displacing the first and second arms 40, 42 with respect to the body 16.

In this example, the displacement of the first and second arms 40, 42 with respect to the body 16 is a combination of a rotation about the coupling axis X and of a translation along the longitudinal direction L.

It can be seen that the upper end of the actuating device 50 is attached to the upper end part 16*a* of the body 16.

In this example, the upper ends of the first and second actuators 52, 54 are attached to the upper end part 16*a* of the body 16.

In accordance with the invention, the frame bears a first milling drum 60 and, in this example, the frame moreover bears a second milling drum 62. The first milling drum 60 is rotary about a first axis of rotation A1, perpendicular to the longitudinal direction L, while the second milling drum 62 is rotary about a second axis of rotation A2 which, in this example, is parallel to the first axis of rotation A1.

The boring machine 10 moreover includes a first motor to drive the first milling drum 60 in rotation about the first axis of rotation A1, and a second motor to drive the second milling drum 62 about the second axis of rotation A2.

The first and second motors are housed in the first and second milling drums 60, 62. This arrangement is moreover known, and will not be described in further detail here. Without departing from the scope of this invention, the first and second motors can alternatively be disposed above the first and second milling drums, in a structure which is also known.

In accordance with the invention, the boring machine 10 further comprises a first support 64 bearing the first milling drum 60 and the first motor. As can be seen in FIG. 1, the first support 64 is connected to the lower end part 40*b* of the first arm 40. The first support 64 is also movable with respect to the body 16 of the frame.

More precisely, in this example the first support 64 is attached to the body 16 pivotably about a first pivoting axis B1.

Moreover, the first support 64 is attached to the lower end part 40*b* of the first arm 40 pivotably about a first axis of pivot C1.

It will therefore be understood that the actuating of the actuating device 50, and more precisely the actuating of the first actuator 52, has the effect of pivoting the first milling drum 60 with respect to the body 16 about the first pivoting axis B1.

It can also be seen that the first pivoting axis B1 is parallel to the first axis of pivot C1, these axes being—in this example—also parallel to the first axis of rotation A1.

Note moreover that the first pivot C1 is disposed above the first pivoting axis B1.

In this example, it will be understood that the actuating of the first actuator 52 has the effect of making the first milling drum 60 pivot with respect to the body 16 about the first pivoting axis B1.

In this example, the boring machine further includes a second support 66 which is movable with respect to the body 16. Moreover, the second milling drum 62 and the second motor are mounted on the second support, the latter being connected to the lower end part 42*b* of the second arm 42.

As can be seen in FIGS. 1 and 2, in the exemplary embodiment described here, the second support 66 is attached to the body 16 pivotably about a second pivoting axis B2. The second support 66 is moreover attached to the lower end part 42*b* of the second arm 42 pivotably about a second pivoting axis C2.

It will be understood that the actuating of the actuating device 50, and more precisely the actuating of the second actuator 54 has the effect of making the second milling drum 62 pivot with respect to the body 16 about the second pivoting axis B2.

Considered in projection in a horizontal plane, it will be understood that the actuating of the first and second actuators 52, 54 has the effect of modifying the distance between the first and second axes of rotation A1 and A2 of the first and second milling drums 60, 62, which makes it possible to make the first and second milling drums transition between a retracted position, illustrated in FIG. 1, and a deployed position, illustrated in FIG. 2. The amplitude of pivoting of each of the first and second supports is preferably between 0° and 60°.

In this example, the first and second axes of pivoting B1, B2 are parallel. Without departing from the scope of this invention, the first and second axes of pivoting B1, B2 could be colinear.

Note moreover that the first and second axes of pivot C1, C2 are disposed above the first and second axes of pivoting B1, B2, while the first axes of rotation A1 and A2 are disposed below first and second axes of pivoting B1, B2.

Moreover, considered along a transverse direction T, which is perpendicular to the longitudinal direction L on the one hand and to the first pivoting axis B1 on the other, it should be noted that the first and second axes of pivoting are located between the first and second axes of pivot.

Moreover, when the boring machine 10 is in the retracted position, the separation between the first and second milling drums 60, 62 is minimal. The boring machine further includes a stop device 70 in order to maintain the minimum separation between the first and second milling drums when the boring machine is in the retracted position.

In this example, the first and second supports 64, 66 are shaped to come into contact with one another when the boring machine is in the retracted position, as illustrated in FIG. 1. The stop device 70 is here formed by stop faces 72, 74 disposed face-to-face on each of the first and second supports. It will be understood that, in the retracted position, the stop faces 72, 74 come into contact with one another.

The first portion 64 includes a first hydraulic junction box 82 connected to the first motor and to hydraulic hoses (not illustrated here) to supply the first motor with hydraulic power. Similarly, the second support 66 includes a second hydraulic unit 84, connected to the second motor, as well as to hydraulic hoses to supply the second motor with hydraulic power.

FIG. 3 illustrates the boring machine 10 according to the invention in which the boring machine with variable geometry is in the deployed position, which makes it possible to excavate cavities E in the soil S on either side of the trench being excavated.

In FIG. 4, the boring machine 10 is used to overcut the vertical edges 300*a*,302*a* of two primary panels 300, 302 disposed on either side of the machine. After excavating a trench between the two primary panels using the boring machine 10, the milling device then being in the retracted position, the milling device is brought into the deployed position and the boring machine 10 is raised such as to overcut the primary panels over a depth p, this depth being considered along a horizontal direction.

In FIG. 5, which illustrates a horizontal section of the boring, the vertical edges 300*a*,300*b* of the panels are overcut over the entire thickness e of the panels. The overcut areas are referenced 304,306.

In FIG. 6, which illustrates a variant of the boring illustrated in FIG. 5, the vertical edges 300*a*,300*b* of the panels are overcut over a fraction of the thickness e of the panels. The overcut areas are referenced 306,308, and form a paving notch. To do this, the width of the milling drums will be adapted to the desired width of the paving notches.

The invention claimed is:

1. A boring machine including:

a frame bearing at least a first milling drum, the frame having a body extending along a longitudinal direction;

at least a first motor to drive the milling drum in rotation about a first axis of rotation;

at least a first arm having a lower end part, the first arm being movable with respect to the body;

at least a first support bearing the first milling drum and the first motor, the first support being connected to the lower end part of the first arm while being movable with respect to the body of the frame, an actuating device connected to the body to displace at least the first arm with respect to the body;

said boring machine being characterized in that the body further includes:

a translational guiding device extending along the longitudinal direction, the boring machine further comprising a movable member disposed in the body above the first support and interacting with the translational guiding device such that the movable member is displaceable with respect to the body along the longitudinal direction while being guided by the translational guiding device, wherein the movable member is housed in the translational guiding device such as to form together a sliding coupling, and the first arm is mounted pivotably on the movable member.

2. The boring machine as claimed in claim 1, wherein:

the first support is attached to the body pivotably about a first pivoting axis, and is attached to the lower end part of the first arm pivotably about a first axis of pivot, whereby the actuating of the actuating device has the effect of making the first milling drum pivot with respect to the body about the first pivoting axis.

3. The boring machine as claimed in claim 2, wherein the first axis of pivot is disposed above the first pivoting axis.

4. The boring machine as claimed in claim 1, wherein the frame further includes a second arm which is connected to the movable member, the second arm having a lower end part, the first and second arms being pivoting with respect to one another, the actuating device being configured to displace the second arm with respect to the body, said boring machine further including:

a second milling drum and a second motor to drive the second milling drum in rotation about a second axis of rotation; and a second support which is movable with respect to the body, the second milling drum and the second motor being mounted on the second support, the second support being connected to the lower end part of the second arm.

5. The boring machine as claimed in claim 4, wherein:

the second support is attached to the body pivotably about a second pivoting axis, and is attached to the lower end part of the second arm pivotably about a second axis of pivot, whereby the actuating of the actuating device has the effect of making the second milling drum pivot with respect to the body about the second pivoting axis.

6. The boring machine as claimed in claim 5, wherein the first and second axes of pivoting are parallel.

7. The boring machine as claimed in claim 5, wherein the first and second axes of pivot are located above the first and second axes of pivoting.

8. The boring machine as claimed in claim 5, wherein, considered along a transverse direction perpendicular to the longitudinal direction and to the first pivoting axis, the first and second axes of pivoting are located between the first and second axes of pivot.

9. The boring machine as claimed in claim 4, wherein the boring machine has a retracted position wherein the separation between the first and second milling drums is minimal, the boring machine further including a stop device in order to maintain the minimum separation between the first and second milling drums when the boring machine is in the retracted position.

10. The boring machine as claimed in claim 9, wherein the first and second supports are shaped to come into contact with one another when the boring machine is in the retracted position, the stop device consisting of stop faces disposed face-to-face on each of the first and second supports.

11. The boring machine as claimed in claim 4, wherein the actuating device includes a first actuator which is connected to the body and to the first arm to displace the first arm with respect to the body, and a second actuator which is connected to the body and to the second arm to displace the second arm with respect to the body.

12. The boring machine as claimed in claim 1, wherein the first motor is hydraulic.

13. The boring machine as claimed in claim 1, wherein the frame further includes a swivel joint which is connected to the body by way of a removable element.

14. The boring machine as claimed in claim 1, wherein the translational guiding device includes two parallel rails extending along the longitudinal direction of the body and together delimiting a passage for the movable member.

15. The boring machine as claimed in claim 1, wherein the translational guiding device is separate from the actuating device.

16. The boring machine as claimed in claim 1, wherein the translational guiding device is integrated into the frame, and the movable member is disposed in the frame.

* * * * *